US011796197B2

(12) United States Patent
Cash et al.

(10) Patent No.: US 11,796,197 B2
(45) Date of Patent: Oct. 24, 2023

(54) MODULAR RECYCLING AIR CURTAIN DEVICE

(71) Applicants: James T. Cash, Hackettstown, NJ (US); Olivia Z. Cash, Hackettstown, NJ (US)

(72) Inventors: James T. Cash, Hackettstown, NJ (US); Olivia Z. Cash, Hackettstown, NJ (US)

( * ) Notice: Subject to any disclaimer, the term of this patent is extended or adjusted under 35 U.S.C. 154(b) by 351 days.

(21) Appl. No.: 17/380,722

(22) Filed: Jul. 20, 2021

(65) Prior Publication Data

US 2022/0010995 A1 Jan. 13, 2022

Related U.S. Application Data

(63) Continuation-in-part of application No. 16/923,681, filed on Jul. 8, 2020, now Pat. No. 11,226,122.

(51) Int. Cl.

| | |
|---|---|
| ***F24F 9/00*** | (2006.01) |
| ***F24F 8/10*** | (2021.01) |
| ***F24F 8/22*** | (2021.01) |

(52) U.S. Cl.

CPC ..... *F24F 9/00* (2013.01); *F24F 8/10* (2021.01); *F24F 8/22* (2021.01); *F24F 2009/002* (2013.01); *F24F 2009/007* (2013.01)

(58) Field of Classification Search

CPC ..... F24F 8/10; F24F 8/22; F24F 9/00; F24F 2009/002; F24F 2009/007

USPC ..... 454/191

See application file for complete search history.

(56) References Cited

U.S. PATENT DOCUMENTS

| | | | | |
|---|---|---|---|---|
| 2,507,634 A | | 5/1950 | Hill | |
| 3,511,162 A | | 5/1970 | Truhan | |
| 5,306,207 A | | 4/1994 | Courts | |
| 5,350,337 A | * | 9/1994 | Kondo | F24F 9/00 454/189 |
| 5,758,387 A | | 6/1998 | McNamara | |
| 6,217,437 B1 | | 4/2001 | Murray | |
| 6,926,664 B2 | | 8/2005 | Koch | |

* cited by examiner

*Primary Examiner* — Allen R. B. Schult
(74) *Attorney, Agent, or Firm* — Thomas J. Germinario

(57) ABSTRACT

A module air curtain and recirculation system that can be incorporated into various tables and workstations that provides 1) an effective air curtain between individuals, 2) a reduction of harmful viruses and 3) the ability for two or more people to be in close proximity without having to wear personal protective equipment such as face masks. The apparatus for indoor air filtration and conditioning creates an air curtain between and around people. The device captures aerosolized droplets expelled from occupants and recirculates cleaned air to operate the air curtain while greatly increasing effective air changes per hour in spaces it is employed. While portable room air purifiers are used to improve the air quality of indoor spaces and reduce particles, allergens, and viruses, they do little to stop the person-to-person transmission of viruses. This device solves these deficiencies. Through applied effort, ingenuity, innovation and testing these issues have been solved by the embodiment of the presently disclosed modular system. Employment of this system can allow businesses, schools and restaurants to resume more normal activity.

9 Claims, 2 Drawing Sheets

MODULAR RECYCLING AIR CURTAIN DEVICE

REFERENCE TO RELATED APPLICATIONS

The present application is a continuation-in-part of U.S. patent application Ser. No. 16/923,681, filed Jul. 8, 2020, the disclosure of which is incorporated herein by reference.

FIELD OF INVENTION

The present invention relates to the general field of air purification and disinfecting systems, and more particular to devices which remove and/or destroy pathogens in the air.

BACKGROUND OF THE INVENTION

The present invention is an apparatus for indoor air filtration and conditioning creating an air curtain between and around people. The device captures aerosolized droplets expelled from occupants and recirculates cleaned air to operate the air curtain while greatly increasing effective air changes per hour in spaces it is employed. While portable room air purifiers are used to improve the air quality of indoor spaces and reduce particles, allergens, and viruses, they do little to stop the person-to-person transmission of viruses. This invention solves these deficiencies. Through applied effort, ingenuity, innovation and testing these issues have been solved by the embodiment of the presently disclosed modular system. Employment of this invention can allow businesses, schools and restaurants to resume more normal activity.

SUMMARY OF THE INVENTION

Presently, air conditioning systems used in homes, office buildings and restaurants can effectively clean and condition air. HVAC systems may be augmented to include viral reducing components such as HEPA filters, electrostatic collectors for fine particulate, and/or UV light to destroy pathogens. These enhancements do little to eliminate virus transmission from person to person. The expelled droplets exhausting out of one person enter the respiratory system of another person who is in close proximity. To reduce transmission the world has adopted the practice of wearing face masks, social distancing and installing physical barriers which has proven to be somewhat effective at reducing viral transmission. Face Masks provide a level of protection by capturing some of the expelled droplets. Unfortunately, this is not practical for activities such as eating and drinking.

It is therefore the purpose of this invention to provide similar or greater protection while eliminating the need for cumbersome PPE. This invention provides further protection through additional air filtration and pathogen removal within the rooms it is employed. In addition to reduction of pathogen transfer between individuals in close proximity these devices increase air purification within the building and allow for an increased percentage of maximum occupancy.

This invention can be applied in a variety of embodiments and is not intended to exclude those that are not shown or to suggest the only ones that are shown. In FIG. 2 for instance, an individual workstation is shown that can be utilized at a cashier station. A similar one placed for the customer side of the counter will protect both individuals and allow removal of transparent dividers and face masks.

Method of reducing transmission of the virus includes three steps. These are: 1) A barrier or system to capture droplets, 2) increasing air exchange in the environment, and 3) removing pathogens through air filtration or other means that reduce concentration including but not limited to destruction through sufficient exposure to UV light. This invention achieves all three of these elements at great efficiency. Recent CFD (computational fluid dynamics) models demonstrate that micro droplets, also referred to as aerosols, expelled from individuals will rapidly evaporate to a size of 5 micron or less. These aerosols can remain suspended in the air for several hours. Optional features include modulating the air humidity or temperature for added comfort. A full-scale test apparatus was constructed to evaluate and achieve these desired results.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
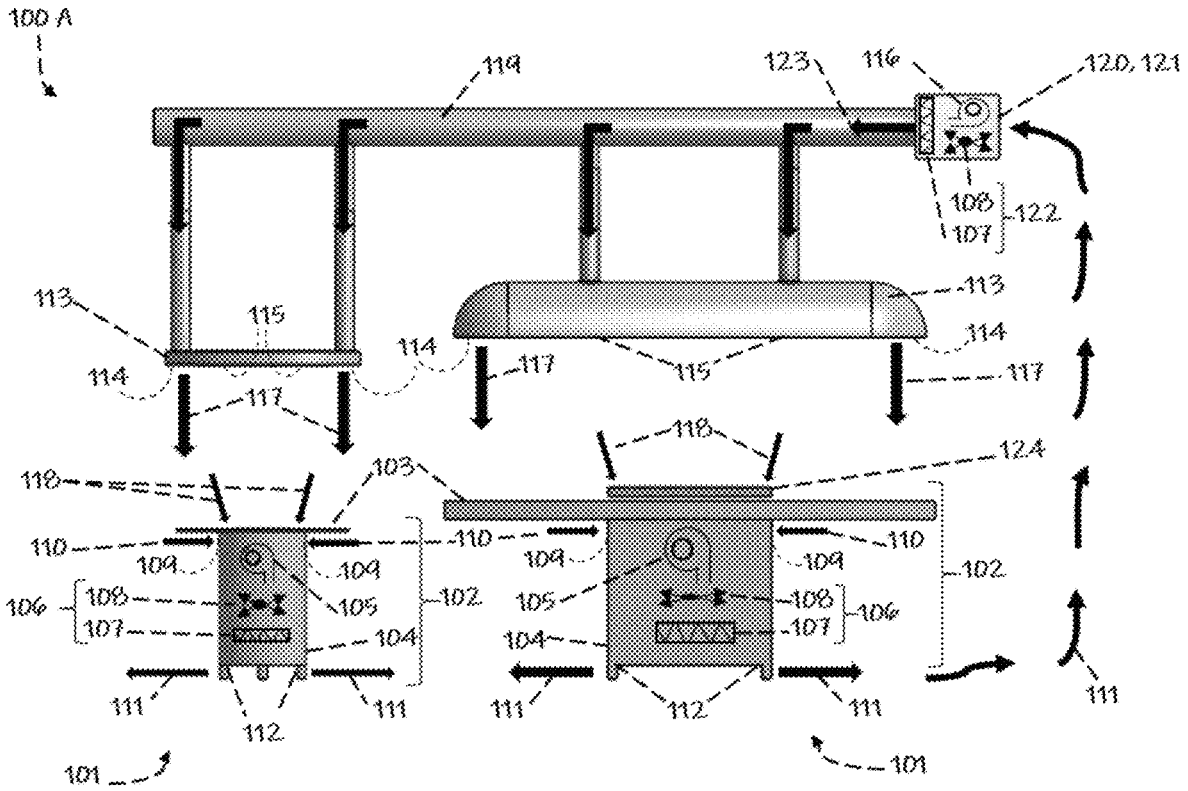
FIG. 1 is a front profile view of the first embodiment of the present invention.
Figure 2:
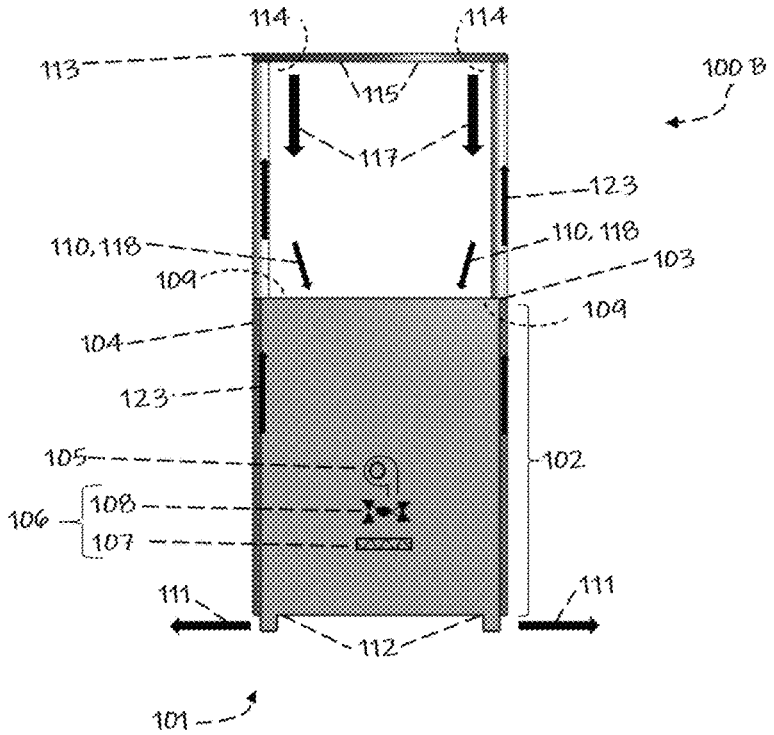
FIG. 2 is a front profile view of the second embodiment of the present invention.
Figure 3:
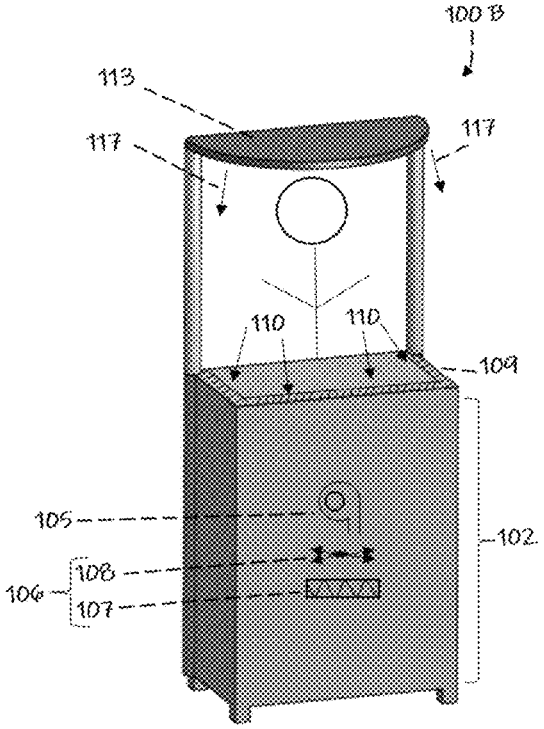
FIG. 3 is a front perspective view of the second embodiment of the present invention.
Figure 4:
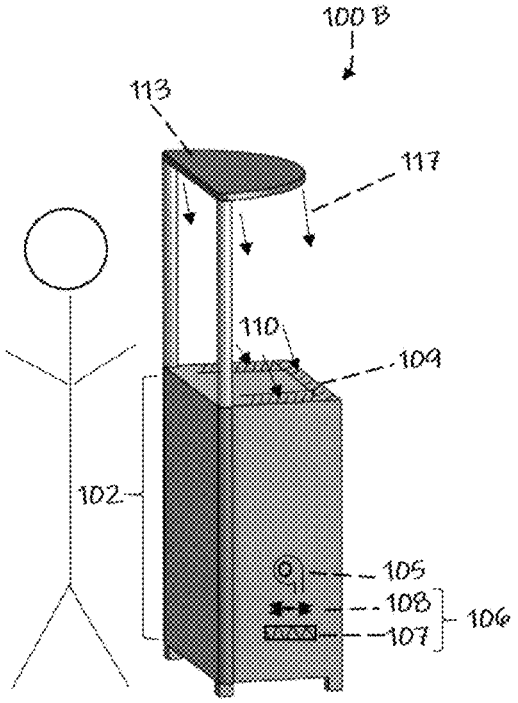
FIG. 4 is a side perspective view of the second embodiment of the present invention.
Figure 5:
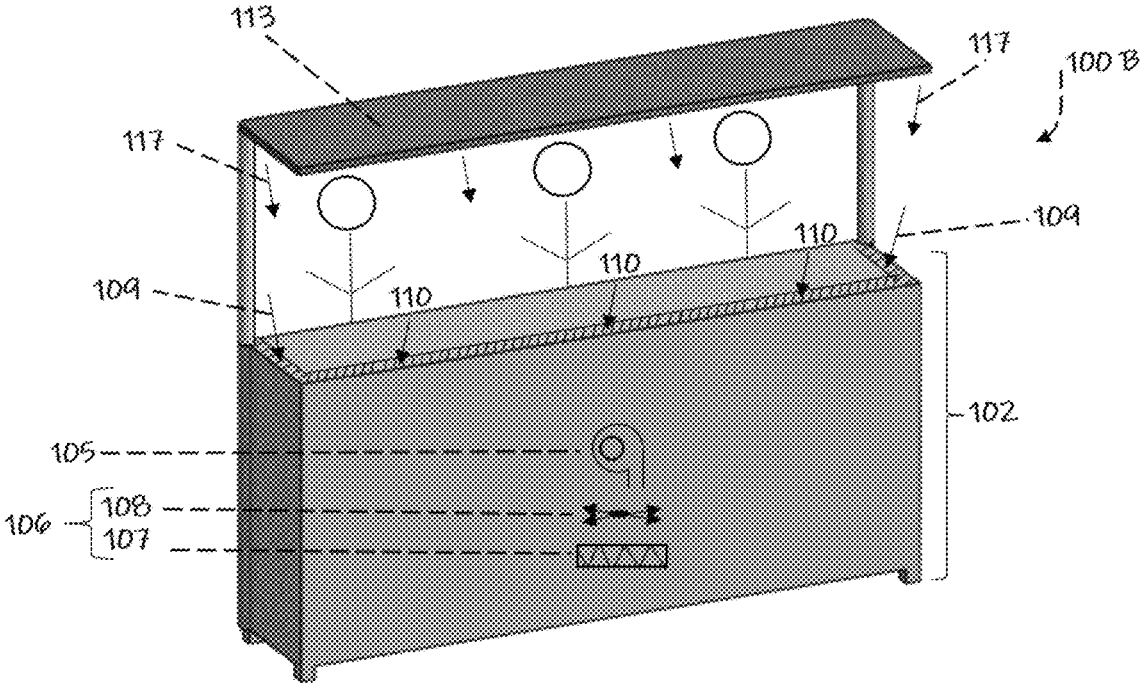
FIG. 5 is a front perspective view of multiple occupants at a counter-service configuration of the second embodiment of the present invention.

Referring to FIGS. 1-5, two exemplary embodiments of the present invention are depicted, both of which are modular air curtain devices 100A-B for treating air in one or more occupant zones 101. The devices comprise one or more table structures 102, each of which is located in one of the occupant zones 101. As used herein and in the claims, a table structure can be any substantially flat, horizontal surface supported from below, and which can serve, for example and without limitation, as a dining table, a desk, a work station, a counter, a podium, a kiosk, a conference table, or an item of furniture.

Each table structure 102 comprises a horizontal, flat table surface 103, and a table support element 104, which supports the table surface 103 from below. Each table support element 104 has an interior that houses a draft fan 105 and one or more primary air treatment systems 106, which are pneumatically connected downstream of the draft fan 105. While the primary air treatment systems 106 are pneumatically connected downstream of the draft fan 105 in this embodiment, it should be understood that they can also be connected upstream of the draft fan 105. The primary air treatment systems can comprise air filters 107, ultraviolet lights 108 and/or electrostatic precipitators (not shown).

In each of the table structures 102 are one or more air intakes 109, in which a negative air pressure is induced by the draft fan 105, so as to draw an intake air flow 110 into the air intakes 109 from one of the occupant zones 101. The intake air flow 110 is drawn by the draft fan 105 downstream into the primary air treatment systems 106, which operate to remove and/or destroy pathogens from the intake air flow 110, so as to produce a treated air flow 111. From one or more treated air outlets 112, located at or near the base of the table support element 104, the treated air flow 111 is expelled from the occupant zone 101 by the positive pressure of the draft fan 105.

Located above each of the occupant zones 101 are one or more exhaust outlets, each of which is pneumatically connected downstream of an exhaust fan 116. Each of the exhaust outlets 113 comprises one or more curtain air nozzles 114 and one or more occupant air nozzles 115. Each of the curtain air nozzles directs a positive pressure curtain air flow 117 around the periphery of one of the occupant zones 101, so as to pneumatically isolate that occupant zone 101 from the ambient atmosphere. Each of the occupant air nozzles 115 directs a positive pressure occupant air flow 118 downward through one of the occupant zones 101, so as to entrain suspended aerosols and suspended pathogens in that occupant zone 101 and carry them into the air intakes 109 of the table structures 102 located in that occupant zone 101.

The first embodiment of the present invention 100A depicted in FIG. 1 has two occupant zones 101, in each of which is located a table structure 102. Above each table structure is an exhaust outlet 113, which is pneumatically connected downstream of an exhaust fan 116. Unlike the second embodiment 100B shown in FIGS. 2-5, the exhaust outlets in the first embodiment 100A are suspended from an overhead exhaust hood 119. The exhaust hood 119 has a hood intake 120, which contains the exhaust fan 116 and one or more secondary air treatment systems 122 pneumatically connected downstream of the exhaust fan 116. While the secondary air treatment systems 122 are pneumatically connected downstream of the exhaust fan 116 in this embodiment, it should be understood that they can also be connected upstream of the exhaust fan 116. The exhaust fan 116 produces a negative pressure at a hood inlet opening 121 upstream of the exhaust fan 116 in the hood intake 120, so that the treated air flow 111 expelled from the occupant zones 101 through the treated air outlets 112 is drawn into the hood intake 120 and is further treated by one or more secondary air treatments systems 122, so as to become a recycled air flow 123. The recycled air flow 123 is forced by the exhaust fan 116 through the exhaust outlets 113 back into the occupant zones 101. Like the primary air treatments systems 106, the secondary air treatment systems 122 can comprise air filters 107, ultraviolet lights 108 and/or electrostatic precipitators (not shown).

Optionally, each of the air intakes 109 in the table structure 102 can be covered by a porous cover 124, which operates to block noise and light from the primary air treatment systems 106 contained in the table support element 104.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A modular air curtain device for treating air in one or more occupant zones, the device comprising:

one or more table structures, wherein each of the one or more table structures is located in one of the one or more occupant zones, such that each of the one or more occupant zones surrounds at least one of the one or more table structures, and wherein the each of the one or more table structures comprises one of one or more substantially horizontal, flat table surfaces and one or more table support elements, and wherein each of the one or more table support elements supports one of the one or more table surfaces, and wherein each of the one or more table support elements houses a draft fan and one or more primary air treatment systems pneumatically connected downstream or upstream of the draft fan;

one or more air intakes, wherein each of the one or more air intakes is located in one of the one or more table structures, and wherein the draft fan in each of the one or more table support elements is operative to induce a negative air pressure at each of the one or more air intakes, so as to draw into each of the one or more air intakes an intake air flow from one of the one or more occupant zones, and wherein the draft fan in each of the one or more table support elements is pneumatically connected upstream or downstream of one of the one or more primary air treatment systems, and wherein each of the one or more primary air treatment systems is operative to remove and/or destroy pathogens from the intake air flow from one of the one or more occupant zones;

one or more treated air outlets, wherein each of the one or more treated air outlets is located in one of the one or more table support elements, and wherein each of the one or more treated air outlets is pneumatically connected downstream of at least one of the one or more primary air treatment systems, and wherein each of the one or more treated air outlets expel from one of the one or more occupant zones a treated air flow from the at least one of the one or more primary air treatment systems;

one or more exhaust outlets, wherein each of the one or more exhaust outlets is located above one of the one or more occupant zones, and wherein each of the one or more exhaust outlets is pneumatically connected downstream of one or more exhaust fans, and wherein each of the one or more exhaust outlets comprise one or more curtain air nozzles and one or more occupant air nozzles, and wherein each of the one or more curtain air nozzles is configured to direct a positive pressure curtain air flow around a periphery of one of the one or more occupant zones, so as to pneumatically isolate the one of the one or more occupant zones from an ambient atmosphere, and wherein each of the one or more occupant air nozzles is configured to direct a positive pressure occupant air flow downward through one or the one or more occupant zones, so as to entrain suspended aerosols and suspended pathogens in the one of the one or more occupant zones and carry the suspended aerosols and suspended pathogens into one of the one or more air intakes located in the one of the one or more occupant zones; and wherein the one or more exhaust fans located upstream of the one or more exhaust outlets have a negative pressure side upstream of the one or more exhaust fans, such that a first component of the treated air flow expelled from the one or more treated air outlets is drawn into the negative pressure side of the one or more exhaust fans and is directed through the occupant air nozzles downward into the one or more air intakes and is drawn by the draft fan into the one or more primary air treatment systems, and wherein the first component of the treated air flow is further treated by the one or more primary air treatment systems so as to become a primary recycled air flow.

2. The device according to claim 1, further comprising an exhaust hood, wherein the exhaust hood has a hood intake, and wherein the hood intake contains the one or more exhaust fans and one or more secondary air treatment systems pneumatically connected downstream or upstream of the one or more exhaust fans, and wherein the one or more exhaust fans produces a negative pressure at a hood inlet opening upstream of the one or more exhaust fans in the hood intake, such that a second component of the treated air flow expelled from the one or more occupant zones through the one or more treated air outlets is drawn into the hood intake through the hood inlet opening, and such that the second component of the treated air is further treated by the one or more secondary air treatment systems so as to become a secondary recycled air flow, and wherein the secondary recycled air flow is forced by the one or more exhaust fans through the one or more exhaust outlets back into the one or more occupant zones.

3. The device according to claim 2, wherein the curtain air flow is between 5% and 40% by volume of a total air flow of the each of the one or more exhaust outlets.

4. The device according to claim 2, wherein the curtain air flow is between 25% and 35% by volume of a total air flow of the each of the one or more exhaust outlets.

5. The device according to claim 3, wherein the each of the one or more exhaust nozzles has a discharge velocity between 800 and 2500 feet per minute.

6. The device according to claim 4, wherein the each of the one or more exhaust nozzles has a discharge velocity between 800 and 2500 feet per minute.

7. The device according to claim 6, wherein the one or more primary air treatment systems comprise air filters, electrostatic precipitators and/or ultraviolet light.

8. The device according to claim 7, wherein one or more secondary air treatment systems comprise air filters, electrostatic precipitators, and/or ultraviolet light.

9. The device according to claim 8, wherein each of the one or more air intakes is covered by a porous cover which is operative to block noise and light from one of the one or more primary air treatment systems.

* * * * *